US008011339B2

(12) United States Patent
Ewert et al.

(10) Patent No.: US 8,011,339 B2
(45) Date of Patent: Sep. 6, 2011

(54) ELECTRONIC MODULE FOR A FAN OF AN INTERNAL COMBUSTION ENGINE IN A MOTOR VEHICLE

(75) Inventors: Andreas Ewert, Lichtenau (DE); Jens Ulrich, Toluca (DE); Markus Liedel, Pegnitz (DE); Ursula Linnenschmidt, Sinzheim (DE)

(73) Assignee: Robert Bosch GmbH, Stuttgart (DE)

( * ) Notice: Subject to any disclaimer, the term of this patent is extended or adjusted under 35 U.S.C. 154(b) by 644 days.

(21) Appl. No.: 11/909,082

(22) PCT Filed: Feb. 16, 2006

(86) PCT No.: PCT/EP2006/060028

§ 371 (c)(1),
(2), (4) Date: Sep. 19, 2007

(87) PCT Pub. No.: WO2006/108730

PCT Pub. Date: Oct. 19, 2006

(65) Prior Publication Data

US 2008/0202453 A1 Aug. 28, 2008

(30) Foreign Application Priority Data

Apr. 14, 2005 (DE) ..... 10 2005 017 266

(51) Int. Cl.
*F02B 67/00* (2006.01)

(52) U.S. Cl. ..... 123/195 A; 123/41.49; 123/41.15; 123/195 C; 123/195 E

(58) Field of Classification Search ..... 123/41.31, 123/41.49, 195 E; 361/600, 664, 666, 728, 361/732; 310/71, 68 R, 67 R, 89, 91, 68 D; 165/80.1, 80.2, 80.3, 80.4; 416/131, 134 R; 174/50; 439/567, 818
See application file for complete search history.

(56) References Cited

U.S. PATENT DOCUMENTS

| | | | | |
|---|---|---|---|---|
| 4,160,576 | A * | 7/1979 | Vettori | 439/191 |
| 5,189,327 | A * | 2/1993 | Ootsuka et al. | 310/71 |
| 6,358,087 | B1 * | 3/2002 | Haar et al. | 439/567 |
| 6,601,546 | B1 | 8/2003 | Mohr et al. | |
| 7,687,953 | B2 * | 3/2010 | Rahbar et al. | 310/91 |
| 2003/0019646 | A1 | 1/2003 | Clements et al. | |
| 2005/0174499 | A1 * | 8/2005 | Clark | 349/16 |

FOREIGN PATENT DOCUMENTS

| | | | |
|---|---|---|---|
| EP | 1000783 | A1 | 5/2000 |
| WO | 2005/026510 | A1 | 3/2005 |

OTHER PUBLICATIONS

PCT/EP2006/060028 International Search Report.

* cited by examiner

*Primary Examiner* — Michael Cuff
*Assistant Examiner* — Hung Q Nguyen
(74) *Attorney, Agent, or Firm* — Michael Best & Friedrich LLP

(57) ABSTRACT

An electronic module for a fan of an internal combustion engine in a motor vehicle comprising at least one deformable element (12, 28, 68), which when deformed can engage with a part (4) of the fan in a detachable manner, and at least one rigid projecting retaining element (24, 66), which can be inserted in a direction of insertion into a receptacle (26) or opening (38, 78) of a fan frame (4) before the deformable element (12, 28, 68) engages, wherein after the retaining element (24, 66) is inserted into the receptacle (26) or opening (38, 78), the electronic module (2) is movable with a single degree of freedom different from the direction of insertion in order to bring the deformable element (12, 28, 68) into engagement with the fan frame.

22 Claims, 5 Drawing Sheets

ELECTRONIC MODULE FOR A FAN OF AN INTERNAL COMBUSTION ENGINE IN A MOTOR VEHICLE

BACKGROUND OF THE INVENTION

The invention relates to an electronic module for a fan of an internal combustion engine in a motor vehicle as well as a fan for cooling an internal combustion engine of a motor vehicle, with an electronic module for controlling the fan.

Newer fans for cooling internal combustion engines in motor vehicles are usually equipped with an electronic module for operating and controlling the fan. In this case, it is customary to use a standardized module in the form of an add-on piece, which is suited for several types of fans with different structural designs and which is fastened to the fan after installation of the fan or after installation of said fan in the motor vehicle. The electronic module is fastened to the fan in the intake air flow on a frame of the fan that is designated as the fan frame, which is fastened on its outer circumference in the motor vehicle and bears the fan drive and the rotatably mounted fan wheel in its center, whereby most of the time a plurality of self-cutting screws are used as fastening agents. However, this type of assembly requires an assembly tool in the form of a screwdriver or power screwdriver as well as a certain time commitment both for assembly as well as for any disassembly that may be necessary.

SUMMARY OF THE INVENTION

The electronic module in accordance with the invention and the fan in accordance with the invention in contrast offer the advantage that the deformable element attached to the electronic module can be engaged manually quickly and without auxiliary agents with the part of the fan serving as a mounting, thereby making time-saving assembly and any disassembly of the electronic module possible.

In comparison to mounting a deformable element on a part of the fan, preferably a fan frame being used as a mounting for the electronic module, the advantage of mounting on the electronic module is also that expenses required in the manufacturing of a fan frame for adaptation, adjustment, sampling and testing of the deformable element are eliminated and thereby both the fabrication expense as well as the tool fabrication times in the manufacturing of fan frames are clearly reduced, because the deformable element, whose production normally incurs greater expense, is integrated into the geometrically standardized component, namely into the electronic module, while the fan frame or another part of the motor vehicle being used for fastening the electronic module for engagement of the deformable element only has to be provided with a simple undercut recess or edge.

A first embodiment or the invention provides for the deformable element to have an elastically deformable snap-in projecting part of the electronic module, which is preferably embodied as a snap-in or locking hook and can engage with an undercut recess or edge on the fan frame. The function of this snap-in projecting part is that, after engaging with the undercut recess or edge of the fan frame, it restricts the freedom of movement between these two components enough so that a stable fastening of the electronic module to the fan frame that is sufficient for vehicle operation is ensured.

A second alternative embodiment of the invention provides for the deformed element to be a partially elastic deformable cable of the electronic module, which is preferably permanently connected to the electronic module and is engaged for example by clipping or looping with deformation to a receptacle that is embodied expediently as a cable guide on the fan frame in order to fasten the electronic module to the fan frame.

In order to keep the number of deformable elements required for fastening the electronic module to a minimum, another preferred embodiment of the invention also provides for at least one rigid projecting retaining element attached to the electronic module at a distance from the deformable element, which retaining element can be inserted into a receptacle or an opening of the fan frame before the deformable element engages with said fan frame and, after engagement of the deformable element, together with said element provides for fixation of the electronic module with respect to the fan frame. The retaining element can also serve to equalize tolerances and/or to limit the movement possibilities of the electronic module and can be provided with suitable geometry for this purpose.

Another advantageous embodiment of the invention provides for the retaining element to also serve as an assembly aid, which after its insertion into the recess of the fan frame permits a single degree of freedom of movement of the electronic module with respect to the fan frame, whereby the snap-in projecting part on the electronic module can be brought into engagement with the undercut recess or edge without additional guidance just via such an assembly movement. The assembly can expediently be either a swiveling movement around an axis of rotation or a translation movement in one direction.

According to another advantageous embodiment of the invention, the deformable element and/or the retaining element engages with a clearance fit in the fan frame so that not only an equalization of tolerances of the electronic module and of the fan frame can be provided for, but also an equalization of tolerances of a cable leading to the electronic module. The electronic module is preferably fastened with play in two directions that are perpendicular to one another on the fan frame, whereby the play in one direction is supplied by a displaceability of the retaining elements and of the snap-in projecting parts and in the other direction by the elastic deformability of the snap-in projecting parts.

BRIEF DESCRIPTION OF THE DRAWINGS

The invention is explained in greater detail in the following in several exemplary embodiments based on the associated drawings. The drawings show.

DETAILED DESCRIPTION

Figure 1:
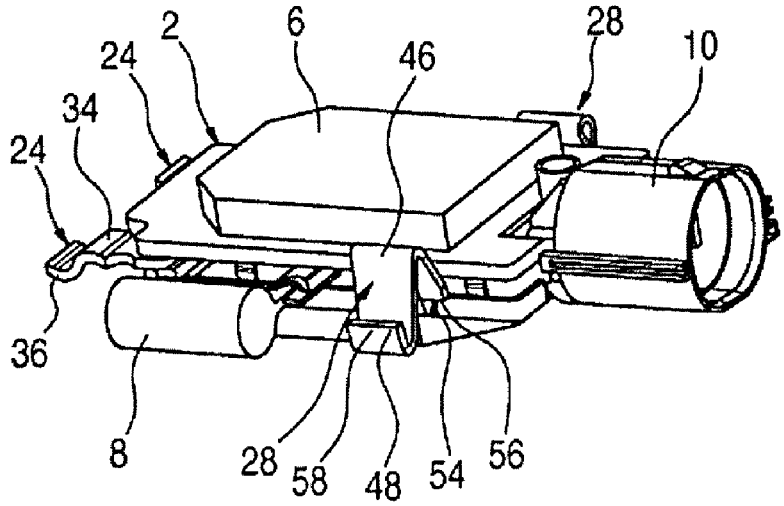
FIG. 1 A perspective view of an electronic module for assembly on a fan frame.

The electronic modules 2 depicted in the drawings are used to electrically or electronically control the speed and power of an electric fan drive of a cooling blower or fan being used to cool an internal combustion engine in a motor vehicle. The fan includes a frame that is depicted partially in FIGS. 3 and 4 (designated as a fan frame 4), which is used to fasten the fan in the motor vehicle and bears the fan drive and the fan wheel (not shown).

Figure 12:
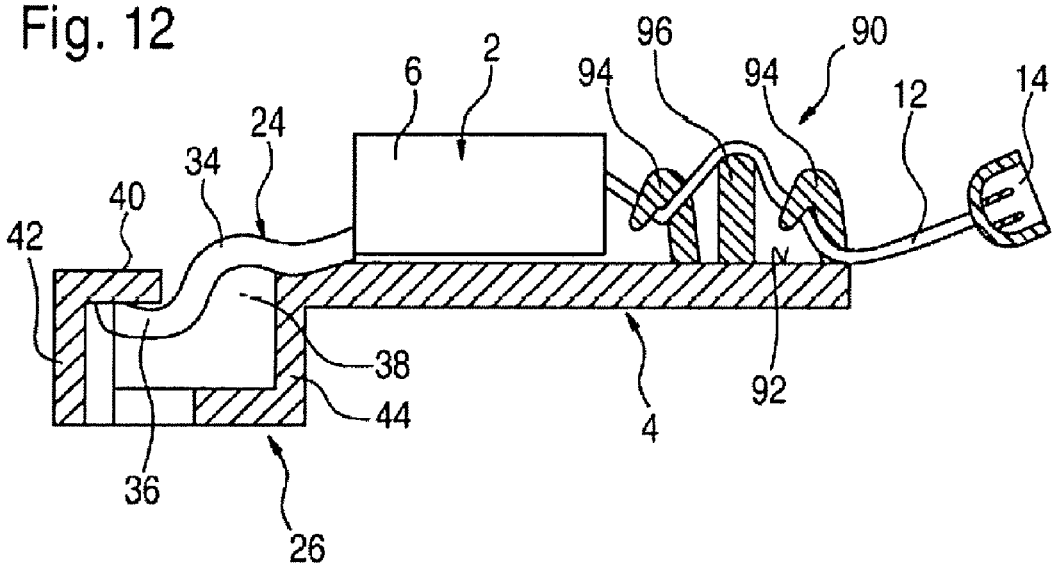
FIG. 12 A partial section of a schematic side view of another modified electronic modules and yet another fan frame.

The electronic modules 2 are each comprised of a circuit board or printed circuit board or a punched grid with electronic or electrical or electromechanical components (not shown) accommodated in a housing 6, a temperature sensor 8 projecting beyond the housing 6 on a longitudinal side of said housing and, for electrical connection to the on-board power supply of the motor vehicle, are provided either with a socket 10 (FIGS. 1 through 6) for a plug cable or alternatively with a fixed plug cable 12 with a plug 14 (FIG. 12).

Figure 4:
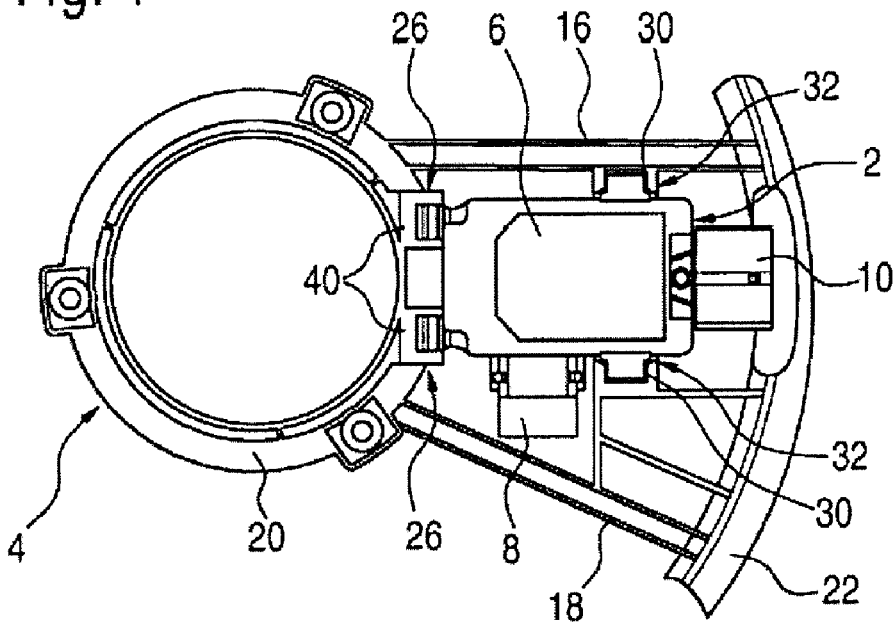
FIG. 4 A view from above of the electronic module and the fan frame after assembly of the electronic module.

As FIG. 4 shows, the electronic modules 2 are mounted between two struts 16, 18 of the fan frame 4, which connect an inner ring flange 20 that fastens the fan drive and an outer ring flange 22 of the fan frame 4 that surrounds the outer circumference of the fan frame so that electronic modules 2 are located in the intake air flow of the fan wheel.

For fastening to the fan frame 4, the electronic module 2 depicted in FIGS. 1 through 4 has, firstly, on its narrow side opposite from the plug socket 10, two rigid projecting retaining tongues 24, which can each be inserted into a tongue receptacle 26 that is formed on the fan frame 4 in the vicinity of the inner ring flange 20. Secondly, the electronic module is provided, on each of its opposing longitudinal sides at a distance from the retaining tongues 24, with a downwardly projecting (in relation to the horizontal alignment of the electronic module 2 in the figures) elastically deformable snap-in or locking hook 28, which can lock into engagement with an undercut snap-in opening 30 in a hook receptacle 32 formed on the strut 16 or 18.

Figure 3:
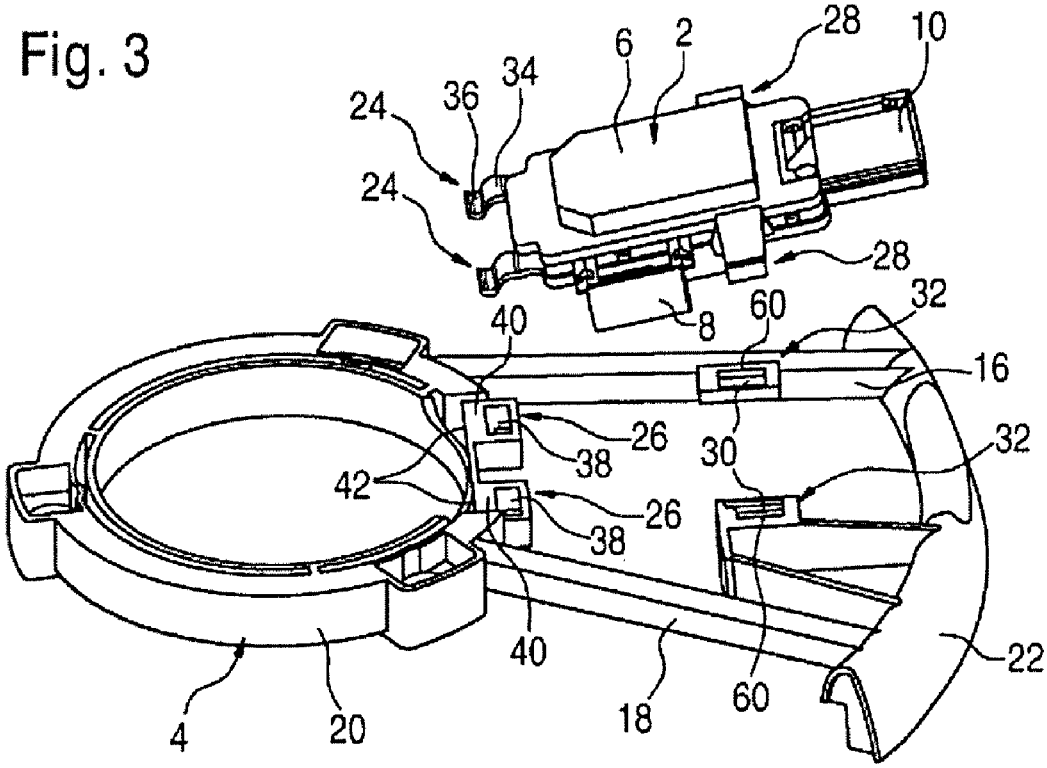
FIG. 3 A perspective view of the electronic module and the fan frame during assembly of the electronic module.

As best depicted in FIGS. 1, 3 and 12, the retaining tongues 24 have a flat S-shaped cross section with a convex upwardly curved section 34 adjacent to the housing 6 of the electronic module 2 and a convex downwardly curved end section 36, whose free end is aligned approx. parallel to the level upper and under side of the housing 6 and with horizontal alignment of the electronic module 2 lies somewhat beneath the convex upwardly curved section 34.

As depicted best in FIGS. 3 and 12, the two tongue receptacles 26 each have a rectangular opening 38 in their upper side facing the electronic module 2, through which the free end of the associated retaining tongue 24 can be inserted into the receptacle 26. As FIG. 12 shows best, the receptacle 26 is limited radially inwardly (in relation to the axis of rotation of the fan wheel) from the opening 38 upwardly by a molding 40, which projects in the direction of the opening 38 over an adjacent inner limiting wall 42 of the receptacle 26 and with its underside serves as a limit stop for the free end of the concave end section 36 of the retaining tongue 24 when, in the assembly position of the electronic module 2 (see FIG. 4), the convex section 34 rests on an outer limiting wall 44 of the receptacle 26 (see FIG. 12) and the two snap-in hooks 28 are locked into place in the hook receptacles 32. The width of the opening 38 and the distance between the two limiting walls 42 and 44 is selected so that, after insertion of the retaining tongues 24 into the tongue receptacles 26, the electronic module 2 can swivel around an assembly axis of rotation running crosswise to the retaining tongues 24 through the tongue receptacles 26 in order to lock the snap-in hooks 28 into engagement with the hook receptacles 32.

Figure 2:
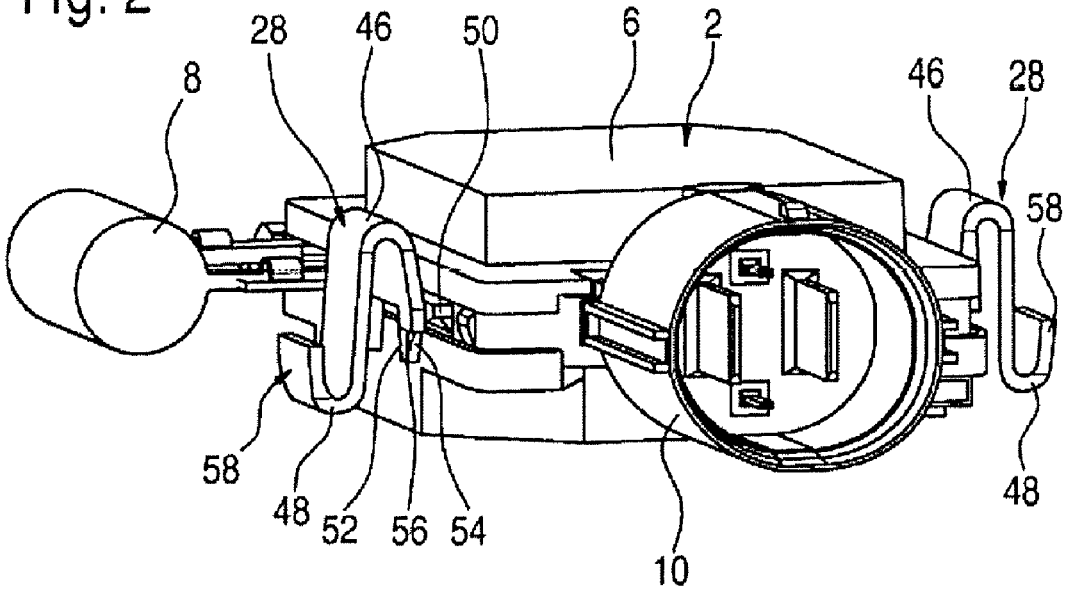
FIG. 2 Another perspective view of the electronic module.

Instead of two retaining tongues 24 arranged next to one another at a distance, as depicted in FIGS. 1 through 3, a single retaining tongue (not shown) can also be provided, which can be inserted into a corresponding single tongue receptacle in the fan frame.

As FIGS. 1 and 2 depict best, the two snap-in hooks 28 formed of an elastic plastic or bent from steel sheet each have an S-shaped cross section, which consists of a convex upwardly curved section 46 facing the housing 6 and a convex downwardly curved end section 48. The section 46 is provided on its housing-side end with an anchoring part 50 projecting into the interior of the housing 6, and, on the sides of the anchoring part 50, has two extension projections 52 projecting downwardly, whose outer sides that face away from one another are formed as slanted insertion bevels 54. The insertion bevels 54 make it easier to insert the snap-in hooks 28 into the hook receptacles 32 and serve as longitudinal limit stops in the hook receptacles 32, which restrict movement parallel to the longitudinal sides of the electronic module 2 to a desired degree or play. The section 46 is widened somewhat above the two extension projections 52, whereby the level under sides of two shoulders 56 formed on both sides of the extension projections 52 each form fixed limit stops to the left and right of the projections 52, which limit stops serve to limit the path when inserting the respective snap-in hook 28 in the associated hook receptacle 32 and, to do so, hit against the upper side of adjacent lateral limiting edges of the snap-in opening 30.

When the snap-in hooks 28 penetrate the rectangular snap-in opening 30 in the upper sides of the hook receptacles 32 from above when the electronic module 2 pivots around the assembly axis of rotation, the upwardly pointing legs 58 of their end sections 48 move along the limiting edges 60 of the snap-in openings 30 facing away from the housing 6 of the electronic module 2 into the hook receptacles 32. In doing so, the snap-in hooks 28 are deformed elastically and compressed against the housing 6 until the free ends of the legs 58 reach under the undercut limiting edges 60 of the snap-in openings 30 and lock into place there. When locking into place, the free ends of the legs 58 grip under the adjacent outer limiting edge 60 of the snap-in openings 30, whereby they abut the limiting walls of the hook receptacles 32 beneath the snap-in openings 30 with their outer sides with a certain residual stress and thereby hold the electronic module 2 in place with a clearance fit on the fan frame 4 in a direction transverse to its longitudinal sides. Because of the play between the insertion bevels and the adjacent lateral limiting edges of the hook receptacles 32 or snap-in openings 30 and because of an axial play of the retaining tongues 24 in the tongue receptacles 26, the electronic module 2 can also shift in the direction of its longitudinal sides by a certain degree so that equalization of tolerances is possible in both directions.

Figure 5:
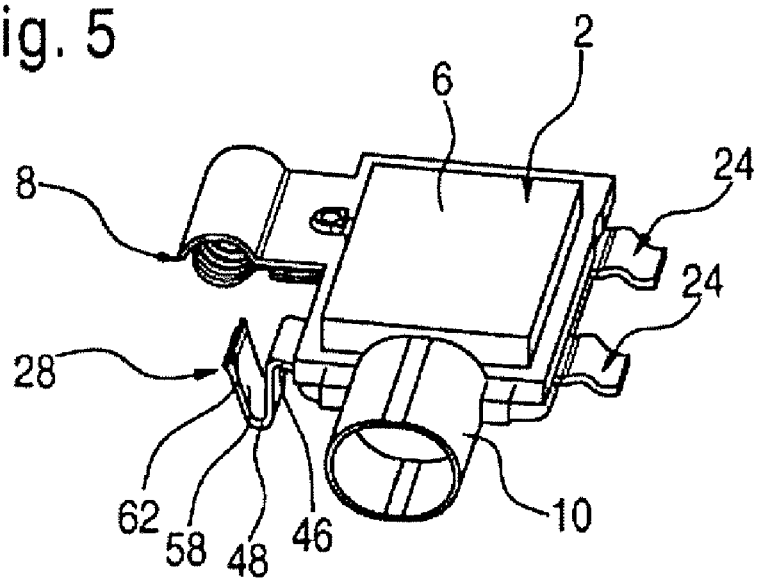
FIG. 5 A perspective view of a modified electronic module.
Figure 6:
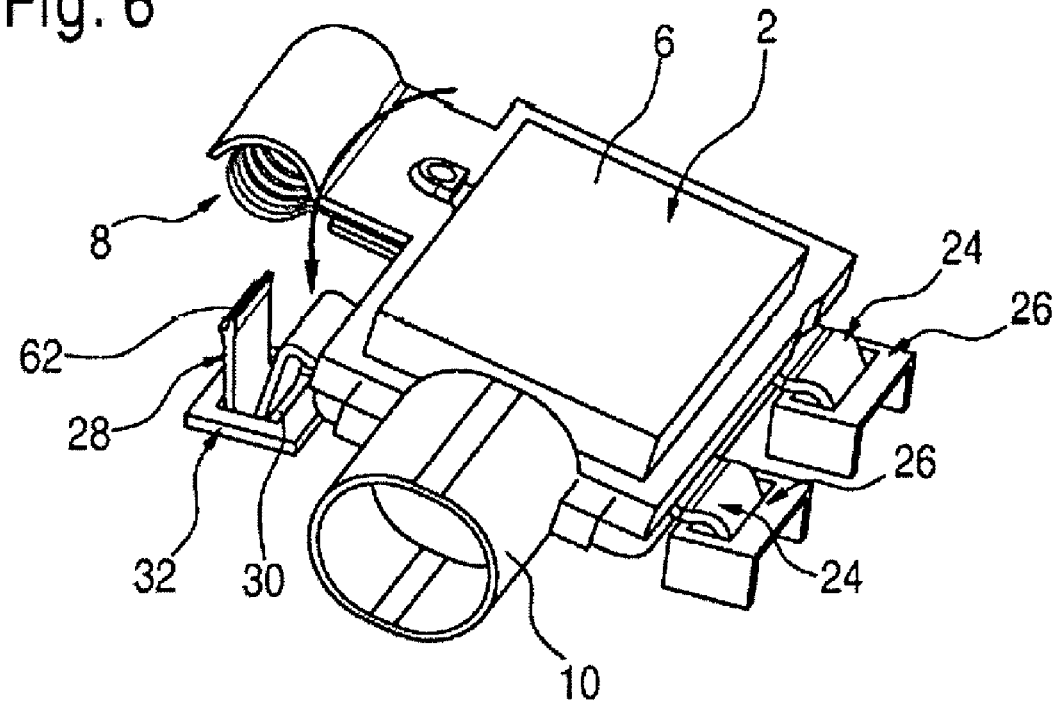
FIG. 6 A perspective view of the electronic module from FIG. 5 during assembly to the fan frame.
Figure 7:
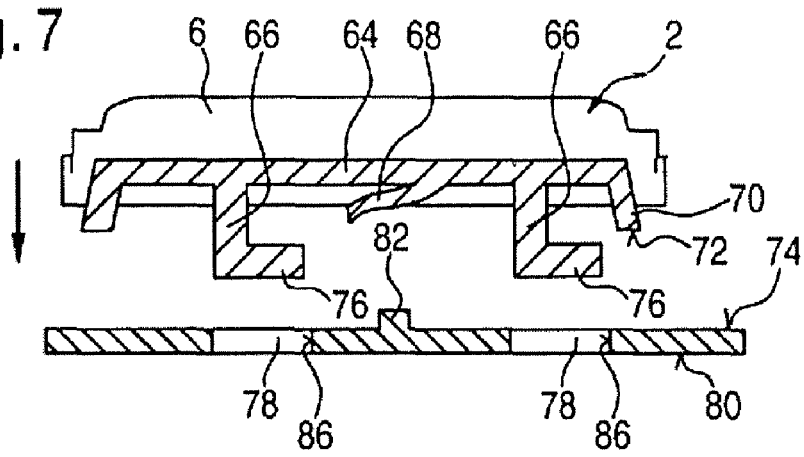
FIGS. 7 through 10 Partial sections of schematic side views of another modified electronic module and a modified fan frame in various assembly steps.

FIGS. 5 and 6 show another electronic module 2, in which the two retaining tongues 24 are attached on the longitudinal side of the electronic module 2 opposite from the temperature sensor 8, while a single snap-in hook 28 is arranged next to the temperature sensor 8 and said snap-in hook can engage with a snap-in opening 30 of a hook receptacle 32 of the fan frame 4. In this connection, FIG. 6 shows the status after the retaining tongues 24 have been inserted into the adjacent tongue receptacles 26 of the fan frame 4, when, as the arrow indicates, the electronic module 2 is swiveled around the assembly axis of rotation located in this area in order to insert the snap-in hook 28 into the snap-in opening 30 and engage with the hook receptacle 32.

In order to facilitate detachment of the snap-in hook for possible disassembly of the electronic module 2, the snap-in hook 28 of the electronic module from FIGS. 5 and 6 has a narrow extension part 62 projecting over the free end of the end section 48 or of the leg 58, and said extension part projects upwardly through the snap-in opening 30 and can be acted upon with force in order to compress the snap-in hook 28 manually.

Instead of the retaining tongues 24 and the snap-in hook 28, the electronic module 2 depicted in FIGS. 7 through 10 has two hook projections 66 on one side at a distance from one another that project beyond a fastening element 64 of the electronic module 2 and an elastically deformable snap-in tongue 68 arranged between the two hook projections 66.

Figure 8:
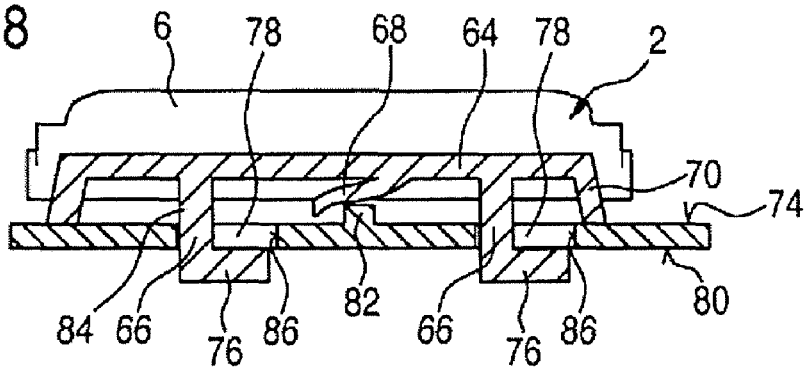
Figure 9:
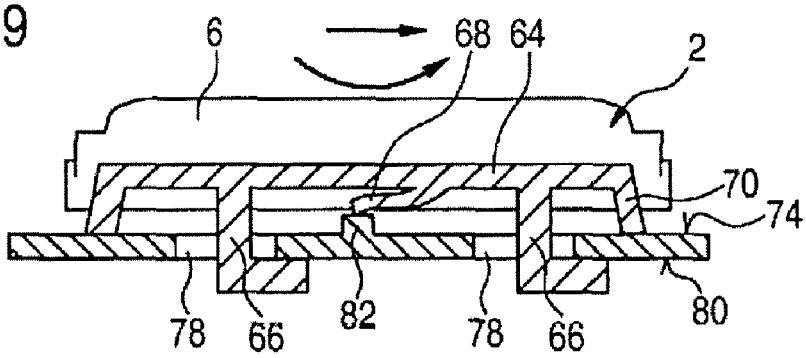

The fastening element 64 that is partially embedded in the housing 6 of the electronic module 2 has, for improved cooling, an edge part 70 that projects beyond a wide side of the housing 6 and has a level bearing surface 72. Said bearing surface can be brought to bear with a neighboring level wide side surface 74 of the fan frame 4, after the ends 76 of the two hook projections 66, which ends are bent parallel to the bearing surface 72, have been moved through complementary locking openings 78 having a slightly larger opening cross section in the fan frame 4, as shown in FIG. 8. Then the electronic module 2 is shifted parallel to the wide side surface 74 of the fan frame 4 or rotated around an axis of rotation perpendicular to the wide side surface 74 of the fan frame 4, as the arrow in FIG. 9 indicates, in order to move the free ends 76 of the hook projections 66 (that project on one side) under the wide side surface 80 of the fan frame 4 that faces away from the electronic module 2. In doing so, when elastically deformed, the snap-in tongue 68 moves over a projecting part 82 on the wide side surface 74 of the fan frame 4 and locks into place behind the projecting part 82, when the parts 84 of the hook projections 66 perpendicular to the wide side surface 74 of the fan frame 4 that are above their bent free ends 76 hit against an adjacent limiting edge 86 of the locking openings 78, as depicted in FIG. 10.

After it locks into place behind the projecting part 82, the flexible elastic snap-in tongue 68 that is integrated into the fastening element 64 prevents undesired displacement or disassembly of the electronic module 2 due to vibrations caused by driving.

Figure 10:
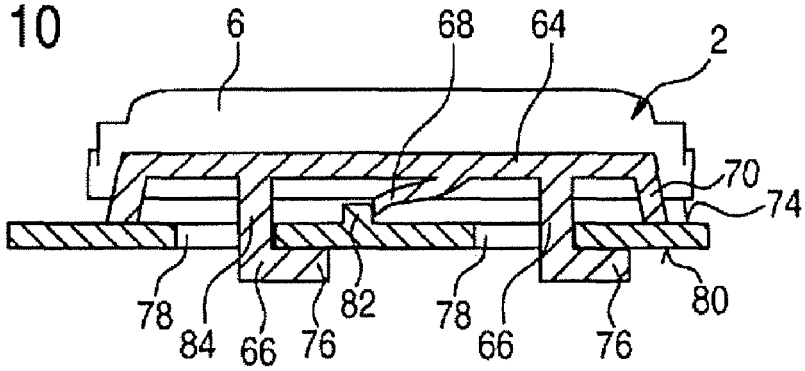
Figure 11:
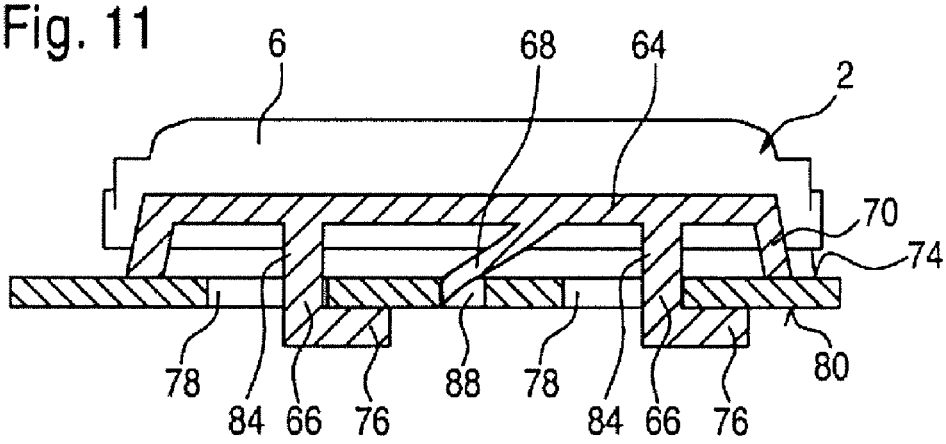
FIG. 11 A partial section of a schematic side view of the electronic module from FIGS. 7 through 10 after assembly on another fan frame.

FIG. 11 shows a modification of the fan frame 4 depicted in FIG. 10, in which, instead of the projecting part 82 on the wide side surface 74 of the fan frame 4, a snap-in opening 88 has been left free in the fan frame 4, with which the snap-in tongue 68 can engage in the assembly position of the electronic module 2.

The electronic module 2 depicted in FIG. 12 is provided on one side with one or more retaining tongues 24, whose embodiment corresponds to that of the retaining tongues 24 of the electronic module 2 in FIGS. 1 through 6 and, just like the hook receptacles 26 in connection with these, have already been already described. However, in this case, instead of snap-in hooks 28 or snap-in tongues 68, the cable 12 leading from the electronic module 2 to the on-board power supply of the motor vehicle and whose one end is permanently connected to the electronic module 2 is used to fasten the electronic module 2 on the fan frame 4. To fasten the electronic module 2, the cable 12 when partially elastically deformed is brought into engagement with a cable receptacle 90 formed on the fan frame 4.

The cable receptacle 90 is comprised of two hook-like cable guide elements 94 formed on the fan frame 4 and projecting beyond a wide side surface 92 of the fan frame 4, under which the cable 12 is fed, as well as a bar-shaped cable guide element 96 arranged between the elements 94, over which the cable 12 is fed. Other embodiments are also conceivable, however.

The invention claimed is:

1. An electronic module for a fan of an internal combustion engine in a motor vehicle comprising at least one deformable element (12, 28, 68), which when deformed can engage with a part (4) of the fan in a detachable manner, and at least one rigid projecting retaining element (24, 66), which can be inserted in a direction of insertion into a receptacle (26) or opening (38, 78) of a fan frame (4) before the deformable element (12, 28, 68) engages, wherein after the retaining element (24, 66) is inserted into the receptacle (26) or opening (38, 78), the electronic module (2) is movable with a single degree of freedom different from the direction of insertion in order to bring the deformable element (12, 28, 68) into engagement with the fan frame.

2. An electronic module according to claim 1, characterized in that the deformable element is a snap-in hook (28), which can be inserted in a hook receptacle (32) with an undercut snap-in opening (30) of the fan frame (4).

3. An electronic module according to claim 1, characterized in that the electronic module (2) can be moved in a rotational manner in order to bring the deformable element (12, 28, 68) into engagement with the fan frame.

4. An electronic module according to claim 1, characterized in that the deformable element (12, 28, 68) and/or the retaining element (24, 66) engages with a clearance fit in the opening or receptacle of the fan frame (4) such that the deformable element is movable relative to the frame transverse to the direction of insertion.

5. An electronic module according to claim 1, characterized in that the electronic module (2) can be moved in a translatory manner in order to bring the deformable element (12, 28, 68) into engagement with the fan frame.

6. A fan for cooling an internal combustion engine in a motor vehicle, with an electronic module to control the fan, characterized in that the electronic module (2) comprises at least one deformable element (12, 28, 68), which engages with a part (4) of the fan and holds the electronic module (2) in place on the fan, and at least one rigid projecting retaining element (24, 66), which can be inserted in a direction of insertion into a receptacle (26) or opening (38, 78) of a fan frame (4) before the deformable element (12, 28, 68) engages, wherein after the retaining element (24, 66) is inserted into the receptacle (26) or opening (38, 78), the electronic module (2) is movable with a single degree of freedom different from the direction of insertion in order to bring the deformable element (12, 28, 68) into engagement with the fan frame.

7. A fan according to claim 6, characterized in that the deformable element is a snap-in hook (28), which can be inserted in a hook receptacle (32) with an undercut snap-in opening (30) of the fan frame (4).

8. A fan according to claim 6, characterized in that the electronic module (2) can be moved in a rotational manner in order to bring the deformable element (12, 28, 68) into engagement with the fan frame.

9. A fan according to claim 6, characterized in that at least one of the deformable element (12, 28, 68) and the retaining element (24, 66) engages with a clearance fit in the opening or receptacle of the fan frame (4) such that the deformable element is movable relative to the frame transverse to the direction of insertion.

10. A fan according to claim 6, characterized in that the electronic module (2) can be moved in a translatory manner in order to bring the deformable element (12, 28, 68) into engagement with the fan frame.

11. An electronic module for a fan of an internal combustion engine in a motor vehicle characterized by at least one deformable element, which when deformed can engage with a fan frame in a detachable manner, wherein the deformable element is an elastically deformable snap-in hook (28), which can be inserted in a hook receptacle (32) with an undercut snap-in opening (30) of the fan frame, the snap-in hook being S-shaped in cross-section.

12. An electronic module according to claim 11, wherein the electronic module includes a housing (6) for electrical components, and wherein the hook (28) has a convex upwardly curved section (46) facing the housing and a convex downwardly curved end section (48).

13. An electronic module according to claim 12, wherein the housing has an interior, wherein the upwardly curved section (46) is provided on a housing-side end with an anchoring part (50) projecting into the interior of the housing, and wherein the hook has, on sides of the anchoring part, two extension projections (52) projecting downwardly, the extension projections having outer sides that face away from one another and are formed as slanted insertion bevels (54) which facilitate insertion of the hooks into the hook receptacles and serve as longitudinal limit stops in the hook receptacles.

14. An electronic module according to claim 13, wherein the upwardly curved section (46) is widened above the two extension projections (52) to form shoulders (56) on both sides of the extension projections (52), the shoulders each forming fixed limit stops on opposite sides of the projections (52), which limit stops serve to limit insertion of the hook into the hook receptacle.

15. An electronic module according to claim 14, wherein, when the snap-in hook penetrates the snap-in opening (30) from above when the electronic module pivots around an assembly axis of rotation, upwardly pointing legs (58) of the downwardly curved end section (48) move along limiting edges (60) of the snap-in opening facing away from the housing into the hook receptacle, whereby the snap-in hook is deformed elastically and compressed against the housing until free ends of the legs (58) reach under the limiting edges (60) of the snap-in opening and lock into place.

16. An electronic module according to claim 15, wherein, in order to facilitate detachment of the snap-in hook for possible disassembly of the electronic module, the snap-in hook has a narrow extension part (62) projecting over a free end of the downwardly curved end section (48) or of the leg (58), and said extension part projects upwardly through the snap-in opening and can be acted upon with force in order to compress the snap-in hook manually.

17. A fan for cooling an internal combustion engine in a motor vehicle, the fan comprising a frame, and an electronic module to control the fan, characterized in that the electronic module (2) comprises at least one deformable element (12, 28, 68), which engages with the fan frame and holds the electronic module (2) in place on the fan frame, wherein the deformable element is an elastically deformable snap-in hook (28), which can be inserted in a hook receptacle (32) with an undercut snap-in opening (30) of the fan frame, the snap-in hook being S-shaped in cross-section.

18. A fan according to claim 17, wherein the electronic module includes a housing (6) for electrical components, and wherein the hook (28) has a convex upwardly curved section (46) facing the housing and a convex downwardly curved end section (48).

19. A fan according to claim 18, wherein the housing has an interior, wherein the upwardly curved section (46) is provided on a housing-side end with an anchoring part (50) projecting into the interior of the housing, and wherein the hook has, on sides of the anchoring part, two extension projections (52) projecting downwardly, the extension projections having outer sides that face away from one another and are formed as slanted insertion bevels (54) which facilitate insertion of the hooks into the hook receptacles and serve as longitudinal limit stops in the hook receptacles.

20. A fan according to claim 19, wherein the upwardly curved section (46) is widened above the two extension projections (52) to form shoulders (56) on both sides of the extension projections (52), the shoulders each forming fixed limit stops on opposite sides of the projections (52), which limit stops serve to limit insertion of the hook into the hook receptacle.

21. A fan according to claim 20, wherein, when the snap-in hook penetrates the snap-in opening (30) from above when the electronic module pivots around an assembly axis of rotation, upwardly pointing legs (58) of the downwardly curved end section (48) move along limiting edges (60) of the snap-in opening facing away from the housing into the hook receptacle, whereby the snap-in hook is deformed elastically and compressed against the housing until free ends of the legs (58) reach under the limiting edges (60) of the snap-in opening and lock into place.

22. A fan according to claim 21, wherein, in order to facilitate detachment of the snap-in hook for possible disassembly of the electronic module, the snap-in hook has a narrow extension part (62) projecting over a free end of the downwardly curved end section (48) or of the leg (58), and said extension part projects upwardly through the snap-in opening and can be acted upon with force in order to compress the snap-in hook manually.

* * * * *